US007854427B2

(12) United States Patent
Tsujinishi

(10) Patent No.: US 7,854,427 B2
(45) Date of Patent: Dec. 21, 2010

(54) PAPER FEED TRAY UNIT FOR A PRINTER

(75) Inventor: Makoto Tsujinishi, Daito (JP)

(73) Assignees: Funai Electric Co., Ltd., Daito-shi (JP); Lexmark International, Inc., Lexington, KY (US)

( * ) Notice: Subject to any disclaimer, the term of this patent is extended or adjusted under 35 U.S.C. 154(b) by 424 days.

(21) Appl. No.: 11/523,692

(22) Filed: Sep. 20, 2006

(65) Prior Publication Data

US 2007/0063425 A1 Mar. 22, 2007

(30) Foreign Application Priority Data

Sep. 22, 2005 (JP) ..... 2005-276878

(51) Int. Cl.
*B65H 1/00* (2006.01)

(52) U.S. Cl. ..... 271/171

(58) Field of Classification Search ..... 271/171, 271/141

See application file for complete search history.

(56) References Cited

U.S. PATENT DOCUMENTS

| | | | | | |
|---|---|---|---|---|---|
| 4,874,160 | A | * | 10/1989 | Yamamoto | 271/227 |
| 4,908,673 | A | * | 3/1990 | Muramatsu | 399/402 |
| 5,168,317 | A | * | 12/1992 | Takano | 399/125 |
| 5,172,178 | A | * | 12/1992 | Oushiden et al. | 399/86 |
| 5,172,903 | A | * | 12/1992 | Haneda et al. | 271/171 |
| 5,573,236 | A | * | 11/1996 | Petocchi et al. | 271/265.02 |
| 5,689,759 | A | * | 11/1997 | Isemura et al. | 399/45 |
| 6,073,925 | A | * | 6/2000 | Sato | 271/171 |
| 6,543,761 | B2 | * | 4/2003 | Endo | 271/110 |
| 6,581,928 | B1 | * | 6/2003 | Stephan | 271/188 |
| 6,619,656 | B2 | * | 9/2003 | Guddanti et al. | 271/171 |

FOREIGN PATENT DOCUMENTS

| | | | | |
|---|---|---|---|---|
| JP | 6-48586 | A | | 2/1994 |
| JP | 8-59022 | A | | 3/1996 |
| JP | 2582359 | B2 | | 11/1996 |
| JP | 2000-169020 | A | | 6/2000 |
| JP | 2000169020 | A | * | 6/2000 |
| JP | 2003-128271 | A | | 5/2003 |
| JP | 2003128271 | A | * | 5/2003 |

OTHER PUBLICATIONS

Japanese Office Action dated Jul. 27, 2010 including English-language translation (Four (4) pages).

* cited by examiner

*Primary Examiner*—Patrick Mackey
*Assistant Examiner*—Patrick Cicchino
(74) *Attorney, Agent, or Firm*—Crowell & Moring LLP

(57) ABSTRACT

A paper feed tray unit for a printer comprises: a paper sensor for detecting a paper on a support; a guide position sensor formed of a reflection photosensor for detecting the position of slide guides; and a paper width detection sheet with marker lines having reflectances corresponding to paper sizes. A controller detects a paper on the support using the paper sensor. If no paper is present, the controller recognizes the position of the slide guides based on a signal from the guide position sensor detected from the paper width detection sheet, and controls a drive mechanism to move the slide guides to a position corresponding to a paper size input by a user before placing a paper on the support. This enables easy paper setting on the support, and prevents the slide guides from moving if a paper is present on the support, preventing the paper from being crushed.

3 Claims, 6 Drawing Sheets

PAPER FEED TRAY UNIT FOR A PRINTER

BACKGROUND OF THE INVENTION

1. Field of the Invention

The present invention relates to a paper feed tray unit for a printer which automatically moves slide guides according to a printing paper size input by a user.

2. Description of the Related Art

A paper feed tray unit for a printer of this type is known in the prior art which automatically positions a pair of slide guides at positions spaced from each other by a distance corresponding to a paper size input by a user (refer e.g. to Japanese Laid-open Patent Publication 2000-169020). More specifically, the paper feed tray unit comprises a paper size recognition means for recognizing the size of printing papers placed on a paper support of the paper feed tray unit, and also comprises a motor drive for moving the slide guides closer to or away from each other in opposite directions which are perpendicular to a paper feed direction so as to achieve the automatic positioning of the slide guides.

This printer has end face sensors which respectively move along with the pair of slide guides for detecting width ends of the printing papers, and also has a movement amount sensor which detects the amount of movement of the slide guides, so as to detect the paper size. When printing papers are placed on the paper support of the paper feed tray unit, the size of the printing papers is detected by the end face sensors and the movement amount sensor so as to actuate the motor drive to move and position the slide guides according to the thus detected paper size.

Another paper feed tray unit for a printer for the positioning of a pair of slide guides is known in the prior art, in which when printing papers are placed on a paper support of the paper feed tray unit, the slide guides are moved to positions spaced from each other by a minimum distance, while the thus placed printing papers are aligned with each other at a predetermined location. This paper feed tray unit has position sensors placed thereon at positions which are spaced from each other in a direction perpendicular to a paper feed direction, and which respectively correspond to standard sizes of printing papers so that the position sensors detect the paper size of the printing papers placed on the paper feed tray unit. The printer has a motor drive which is actuated to move and position the slide guides according to the thus detected paper size (refer e.g. to Japanese Laid-open Patent Publication 2003-128271).

However, such prior art paper feed tray units require the slide guides to be on standby at positions spaced from each other by a maximum distance before the printing papers are placed on the paper support, because the width of the paper size of the printing papers is detected after the printing papers are placed on the paper support. Thus, there is a possibility that a user cannot set printing papers at a predetermined location when placing them on a paper support, so that when the slide guides move to move the printing papers to a predetermined position, or to detect the width of the paper size of the printing papers, the slide guides may crush the printing paper, causing problems such as paper jam at a paper inlet or inside the printer.

SUMMARY OF THE INVENTION

An object of the present invention is to provide such a paper feed tray unit for a printer that can move a pair of slide guides to predetermined positions corresponding to the paper size of a printing paper(s) before a user places the printing paper(s) on a paper support of the paper feed tray unit so as to make it possible for the user to easily and correctly set the printing paper(s) at a predetermined location, preventing the printing paper(s) from being crushed by the slide guides, thereby avoiding an anomaly.

According to the present invention, this object is achieved by a paper feed tray unit for a printer with a controller, comprising: a paper support provided in the vicinity of a paper inlet for feeding the printing paper(s) into the printer in a paper feed direction and for placing a printing paper(s) thereon; a pair of slide guides provided on the paper support so as to be movable in a width direction which is perpendicular to the paper feed direction; a drive mechanism which is provided with a motor drive for moving the slide guides closer to or away from each other in opposite directions, and which is controlled by the controller to automatically move the slide guides to a predetermined position according to a paper size input by a user for printing; a paper sensor for detecting whether or not a printing paper is present on the paper support; and a guide position sensor provided on at least one of the slide guides for detecting the position of the slide guides based on a paper width detection sheet provided in the vicinity of the paper inlet and at a location facing and corresponding to a moving range of the guide position sensor.

Therein, the controller determines, using the paper sensor, whether a printing paper is present on the paper support. The controller recognizes the position of the slide guides based on an output level of a detection signal, which is output from the guide position sensor by detecting the paper width detection sheet, if the controller determines that the paper support is absent of a printing paper thereon. The controller controls the drive mechanism to move the slide guides according to the paper size input by the user for printing. Further, the controller stops the drive mechanism when the output level of the detection signal is equal to a level corresponding to the input paper size. On the other hand, the controller allows the slide guides to stay still if the controller determines, using the paper sensor, that a printing paper is present on the paper support.

Preferably, the guide position sensor is formed of a reflection type photosensor, and the paper width detection sheet is provided with marker lines, each of which is provided at a position facing the guide position sensor when the distance between the slide guides is equal to a width of one of standard paper sizes of printing paper, and each of which has a reflectance different from those of the other marker lines for respective widths of the standard paper sizes.

Further preferably, the paper feed tray unit for the printer comprises a display panel for displaying an operational state of the printer, wherein the controller outputs, to the display panel, the paper size of a printing paper present on the paper support.

The paper feed tray unit for the printer according to the present invention has the following advantage. The controller determines whether a printing paper(s) is present on the paper support. If no printing paper is present on the paper support, the controller controls the drive mechanism to move the slide guides to a predetermined position corresponding to a paper size input by a user for printing before a printing paper(s) is placed on the paper support. Thus, the user can easily and correctly set a desired printing paper(s) at a predetermined location. Furthermore, since the slide guides are not moved when a printing paper(s) is present on the paper support, it is possible to prevent the slide guides from crushing the printing paper(s) on the paper support 6. This in turn makes it possible to prevent paper jam at the paper inlet or inside the printer.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

DESCRIPTION OF THE PREFERRED EMBODIMENTS

Figure 1:
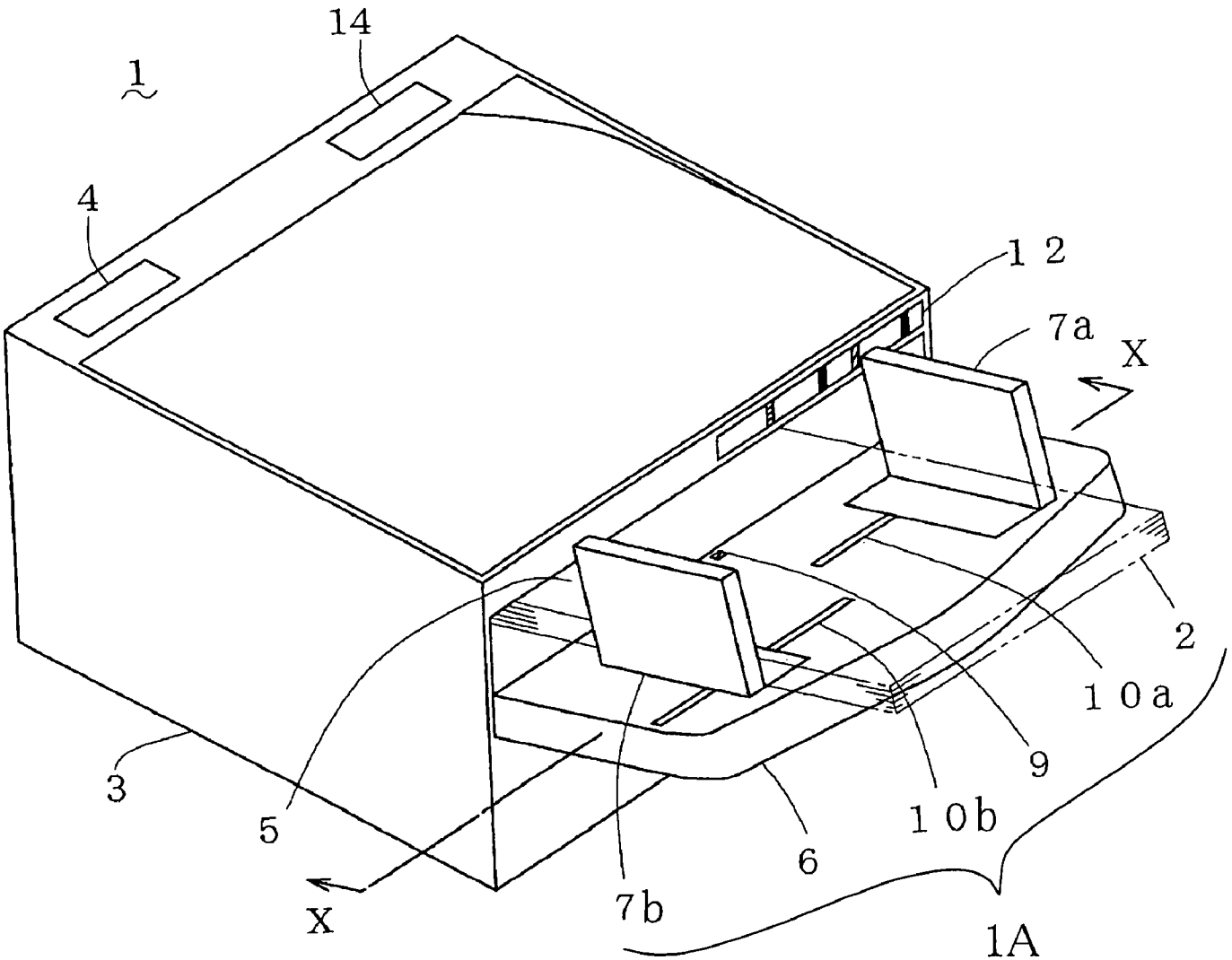
FIG. 1 is a schematic perspective view of a printer and a paper feed tray unit for the printer according to an embodiment of the present invention.

Embodiments of the present invention, as the best mode for carrying out the invention, will be described hereinafter with reference to the annexed drawings. It is to be understood that the embodiments described herein are not intended as limiting, or encompassing the entire scope of, the invention. Note that like parts are designated by like reference numerals or reference characters throughout the drawings.

FIG. 1 is a schematic perspective view of a printer 1 and a paper feed tray unit 1A for the printer 1 according to an embodiment of the present invention. The printer 1 is an apparatus for printing an image(s) on a printing paper(s) 2 based on image data (which can include text data) input e.g. from a personal computer (not shown) connected to the printer 1. The printer 1 has a housing 3 comprising: a display panel 4 provided on a top surface thereof for displaying an operational state of the printer 1; a paper size input panel (input unit) 14 also provided on the top surface thereof and to be used by a user for inputting a paper size; a paper inlet 5 for feeding a printing paper 2 into the printer 1; and a paper width detection sheet 12 provided in the vicinity of the paper inlet 5 and to be used for positioning the slide guides 7. The printer 1 with the paper feed tray unit 1A further comprises a controller (controller 13 shown in FIG. 5 later) for controlling the entire printer 1 and the paper feed tray unit 1A described below.

The paper feed tray unit 1A is attached at or in the vicinity of the paper inlet 5 to the housing 5, and comprises a paper support 6 for placing a printing paper(s) 2 and feeding the printing paper(s) 2 into the printer 1 as well as a pair of slide guides 7*a*, 7*b* provided on the paper support 6 for holding the printing paper(s) 2 at a predetermined location. The paper feed tray unit 1A further comprises a paper sensor 9 for detecting the presence of a printing paper(s) 2 as well as guide slide slits 10*a*, 10*b* for respectively receiving and guiding the slide guides 7*a*, 7*b*. The paper feed tray unit 1 has a function to automatically move the slide guides 7*a*, 7*b* to predetermined positions according to the paper size of the printing paper(s) 2 selected by the user as will be described in detail later.

Figure 2:
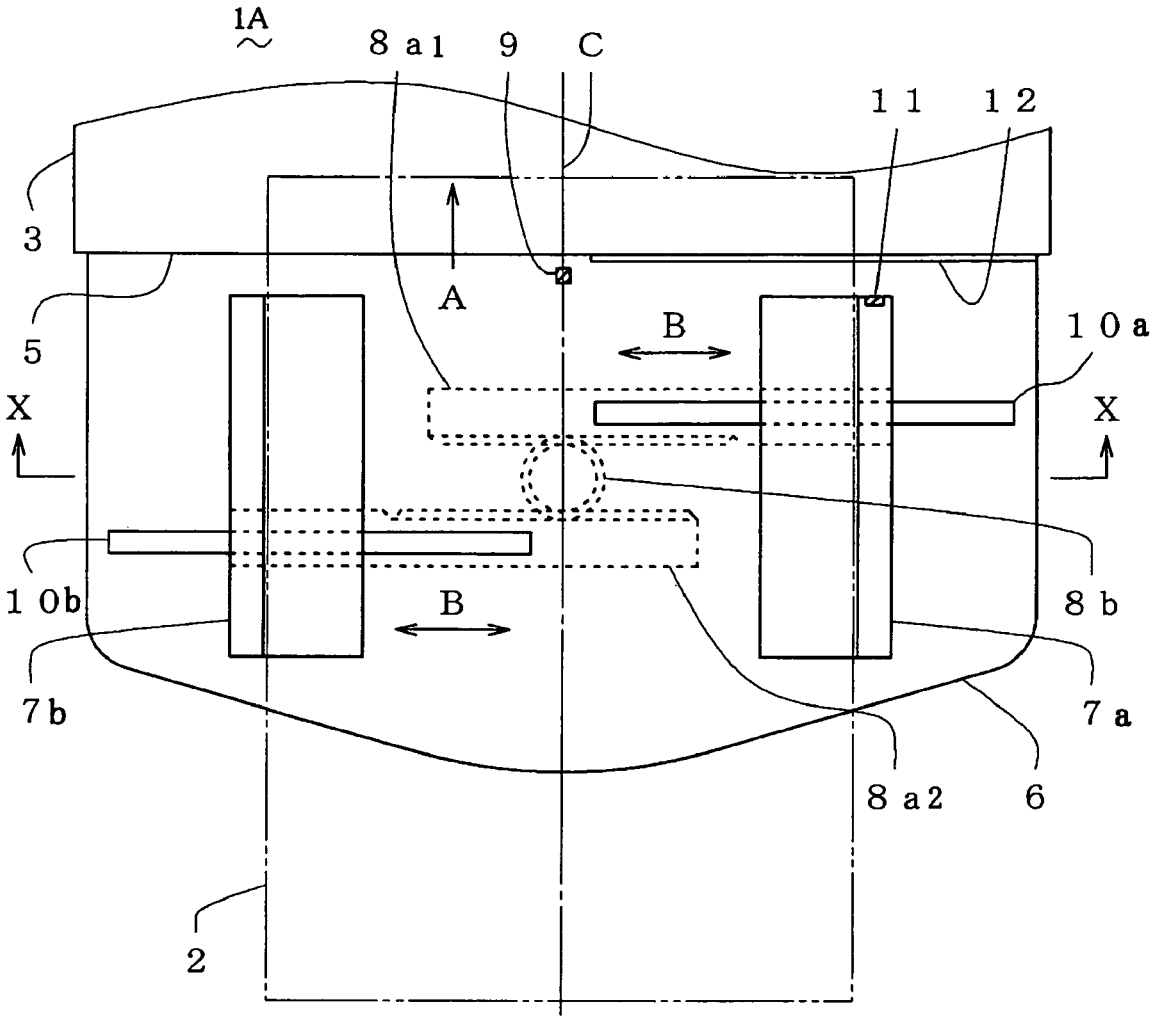
FIG. 2 is a schematic plan view of the paper feed tray unit for the printer.
Figure 3:
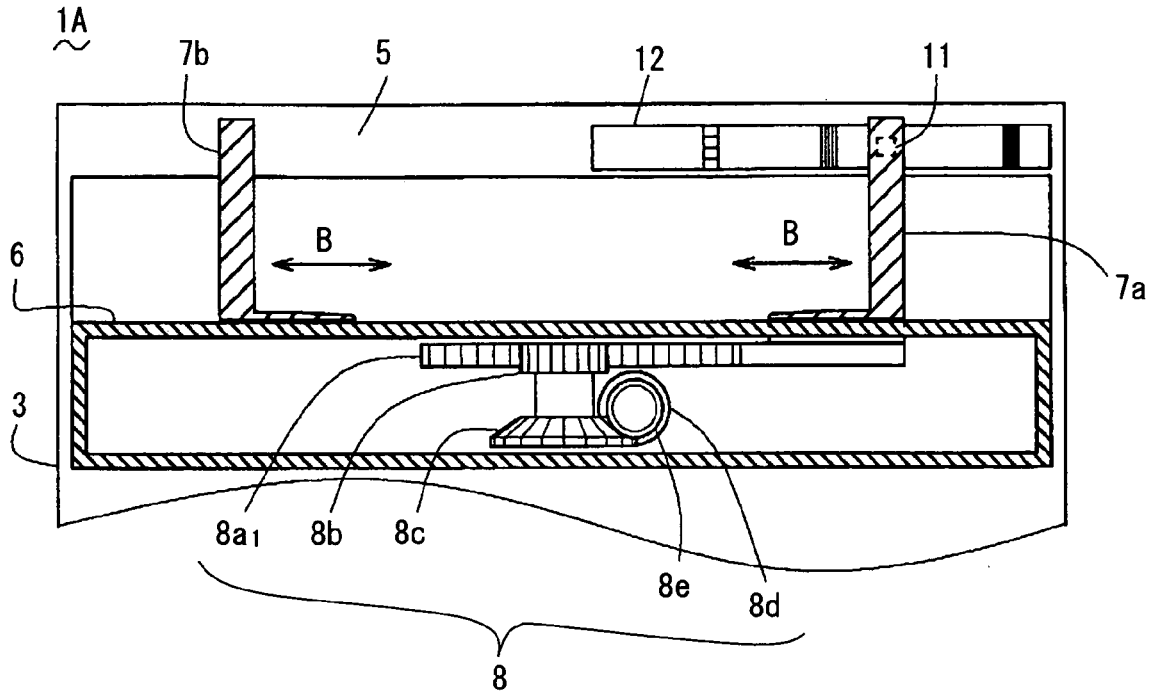
FIG. 3 is a schematic cross-sectional view of the paper feed tray unit as cut along line X-X of FIG. 2.

FIG. 2 is a schematic plan view of the paper feed tray unit 1A for the printer 1 according to the present invention, while FIG. 3 is a schematic cross-sectional view of the paper feed tray unit 1A as cut along line X-X of FIG. 2. Referring to these drawings, the paper feed tray unit 1A attached at the paper inlet 5 to the printer 1 comprises the paper support 6 for placing the printing paper(s) 2, and the pair of slide guides 7*a*, 7*b* which are provided on the paper support 6 for holding, at a predetermined location, a printing paper(s) 2 placed on the paper support 6, and which can slide in a width direction B of the printing paper(s) 2 perpendicular to a paper feed direction A. The paper feed tray unit 1A further comprises a drive mechanism 8 provided with a motor drive for moving the slide guides 7*a*, 7*b* closer to or away from each other in opposite directions, more specifically in antiphase with respect to a center line C between the slide guides 7*a*, 7*b* to make the distance between the center line C and the slide guide 7*a* equal to the distance between the center line C and the slide guide 7*b*.

The paper support 6 is provided with the paper sensor 9 positioned substantially on the center line C of the paper support 6 for detecting whether or not a printing paper(s) 2 is present or placed on the paper support 6. Furthermore, the paper support 6 has the guide slits 10*a*, 10*b* formed therein which respectively face lower ends of the slide guides 7*a*, 7*b* and extend in the width direction B in parallel to each other. The paper sensor 9 can be formed e.g. of a reflection type photosensor having a light emitter and a light receiver.

The slide guide 7*a* is provided with a guide position sensor 11 on a front surface thereof facing the paper inlet 5 for detecting or recognizing the position of the slide guide 7*a* in the guide slit 10*a*, and hence the position of the slide guide 7*b* in the guide slide 10*b* as well (in the width direction B), based on a paper width detection sheet 12 described below. The guide position sensor 11 can be formed e.g. of a reflection type photosensor having a light emitter and a light receiver. The printer 1 has a paper width detection sheet 12 attached or provided on a surface thereof in the vicinity of the paper inlet 5 and at a location facing and corresponding to a moving range of the guide position sensor 11, in which the paper width detection sheet 12 serves as an object to be detected by the guide position sensor 11 for detecting or recognizing the position of the slide guides 7.

The drive mechanism 8 placed below the paper support 6 comprises a pair of rack members 8*a*1, 8*a*2 which are respectively connected to the pair of slide guides 7*a*, 7*b* through the guide slits 10*a*, 10*b*, and which are placed in parallel with each other so that respective teeth of the of rack members 8*a*1, 8*a*2 face other. The drive mechanism 8 further comprises: a pinion gear 8*b* disposed between and meshed with both rack members 8*a*1, 8*a*2 by the teeth; a worm wheel 8*c* connected to the pinion gear 8*b*; and a worm gear 8*e* to transfer the rotational force of a drive motor 8*d* to the worm wheel 8*c*.

Figure 4:
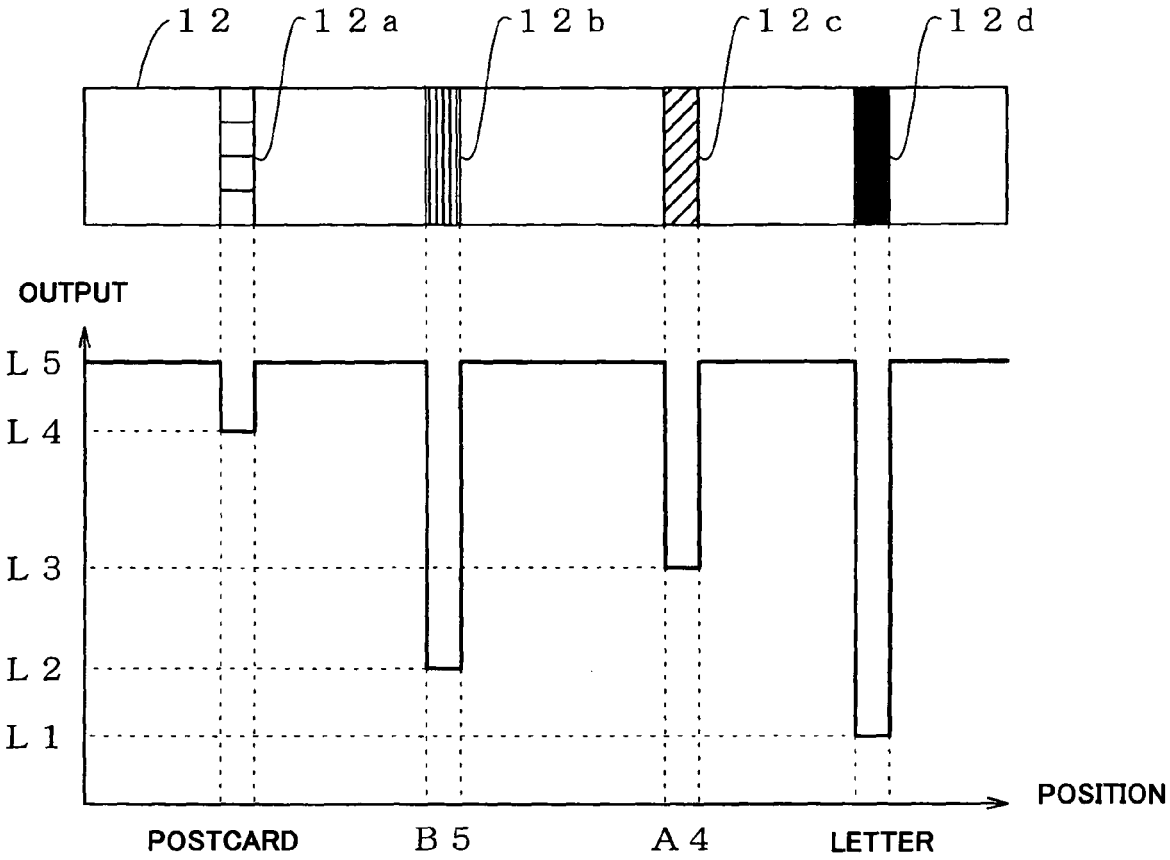
FIG. 4 is a schematic chart showing a paper width detection sheet along with a graph of a relationship between the position of each of marker lines on the paper width detection sheet and an output level of a guide position sensor at each marker line.

FIG. 4 is a schematic chart showing the paper width detection sheet 12, which has marker lines 12*a* to 12*d* drawn or provided thereon corresponding to widths or width ends (i.e. corresponding to standard paper sizes) of four different printing papers (post card size, B5 size, A4 size and letter size), along with a graph of a relationship between the position of each of the marker lines 12*a* to 12*d* (i.e. width end of each of the four different printing papers) and an output level of the guide position sensor 11 at the each marker line. Each of the marker lines 12*a* to 12*d* has a reflectance different from those of the other marker lines, and is provided at a position which faces the guide position sensor 11 of the slide guide 7*a* when the distance between the slide guides 7*a*, 7*b* fits or is equal to the width (size) of each of the four different printing papers with the standard paper sizes.

The reflectances of these marker lines 12*a* to 12*d* are preset so that the guide position sensor 11 outputs output levels L4, L2, L3 and L1 when the guide position sensor 11 detects reflected light from the marker lines 12*a* to 12*d*, respectively. The paper width detection sheet 12 has a white background in an area thereof other than the marker lines 12*a* to 12*d* for the guide position sensor 11 to output a white output level L5. On the other hand, the marker line 12*d* has a black background so that the guide position sensor 11 outputs a black output level L1 when detecting reflected light from the marker line 12*d*. Thus, among these output levels L1 to L5, the output level L1 is set to be the maximum, and the output level L5 is set to be the minimum, while the output levels L2 to L4 are set to be between the maximum level L5 and the minimum level L1.

The marker lines 12*a* to 12*d* correspond to the positions of the width ends (i.e. corresponding to paper sizes) of the four different printing papers with four standard sizes that are post card size, B5 size, A4 size and letter size. More specifically, the marker lines are provided or drawn on the paper width detection sheet 12 at positions which face the guide position sensor 11 of the slide guide 7*a*, respectively, when the distances between the slide guides 7*a*, 7*b* fit or are equal to the widths (sizes) of the four different printing papers. Thus, the guide position sensor 11 can serve to recognize the position of the slide guide 7*a*, and hence the position of the slide guide 7*b* as well, based on the output level thereof which the guide position sensor 11 outputs by detecting reflected light from each of the marker lines 12*a* to 12*d*. Note that for shipping a product (printer 1 with a paper feed tray unit 1A) from factory, the light emitter (e.g. light emitting diode or LED) is subjected to PWM (Pulse Width Modulation) control and calibration to detect reflected light from each of the marker lines 12*a* to 12*d* for the guide position sensor 11 to output an output level, while a later described threshold value is calibrated according to the output level, and the threshold value after calibration is stored in a memory.

Figure 5:
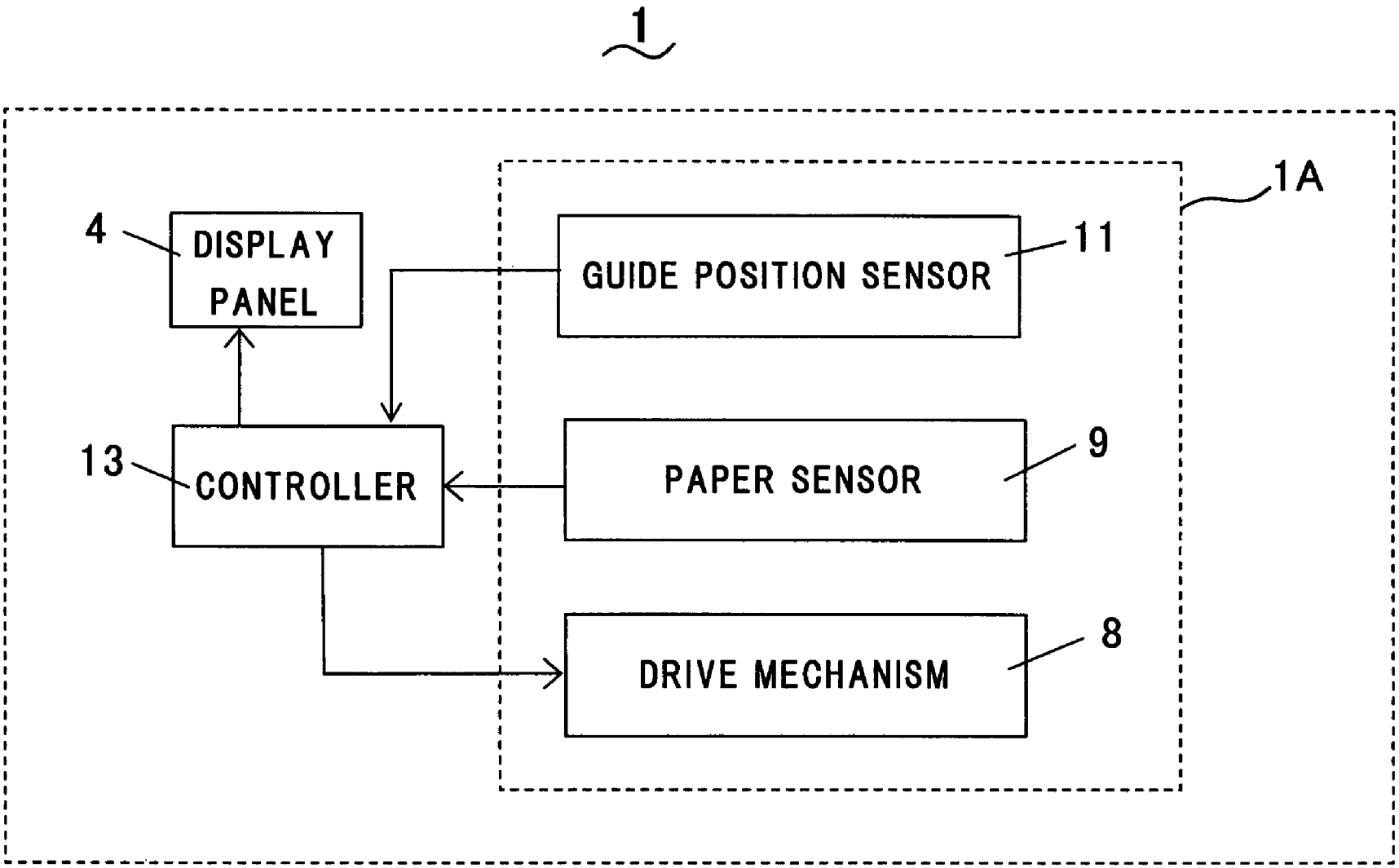
FIG. 5 is a schematic block diagram of the paper feed tray unit for the printer.

FIG. 5 is a schematic block diagram of the paper feed tray unit 1A for the printer 1 according to the present embodiment. As shown in FIG. 5, the printer 1 with the paper feed tray unit 1A comprises a controller 13 for outputting an operational state of the printer 1 to the display panel 4 for display, and for controlling the drive mechanism 8 based on output signals of the paper sensor 9 and the guide position sensor 11 as described in detail below.

According to the paper feed tray unit 1A for the printer 1 having the structure described above, the controller 13 controls the drive mechanism 8 to actuate the drive motor 8 to rotate the pinion gear 8*b* so as to move the rack members 8*a*1, 8*a*2 to simultaneously move in mutually opposite directions. Thus, the pair of slide guides 7*a*, 7*b* connected to the rack members 8*a*1, 8*a*2 move closer to or away from each other in opposite directions along the guide slits 10*a*, 10*b* according to the rotational direction of the pinion gear 8*b*. When a paper(s) 2 is present on the paper support 6, the paper sensor 9 detects reflected light from the paper 2, and outputs, to the controller 13, a detection signal indicating the presence of the paper 2. The guide position sensor 11 detects reflected light from one of the marker lines 12*a* to 12*d* on the paper width detection sheet 12 provided in the vicinity of the paper inlet 5 and at a location facing and corresponding to a moving range of the guide position sensor 11, and outputs, to the controller 13, a detection signal corresponding to the one of the marker lines 12*a* to 12*d*.

The controller 13 determines based on the detection signal from the paper sensor 9 whether or not a printing paper(s) 2 is present on the paper support 6. If the controller 13 determines that no printing paper 2 is present on the paper support 6, namely that the paper support 6 is absent of a printing paper 2 thereon, the controller 13 recognizes the position of the slide guide 7*a* based on the output level of the detection signal from the guide position sensor 11, and outputs, to the drive mechanism 8, a command to move the slide guides 7*a*, 7*b*. When the controller 13 determines that the slide guide 7*a* has reached a predetermined position according to a paper size input by a user using the paper size input panel 14, the controller 13 outputs, to the drive mechanism 8, a command to stop the slide guides 7*a*, 7*b*. On the other hand, if the controller 13 determines based on the detection signal from the paper sensor 9 that a printing paper(s) 2 is present on the paper support 6 based, the controller 13 recognizes the position of the slide guide 7*a* based on the output level of the detection signal from the guide position sensor 11, and outputs, to the display panel 4, the paper size of the printing paper(s) 2 present on the paper support 6 without moving the slide guides 7*a*, 7*b*.

Figure 6:
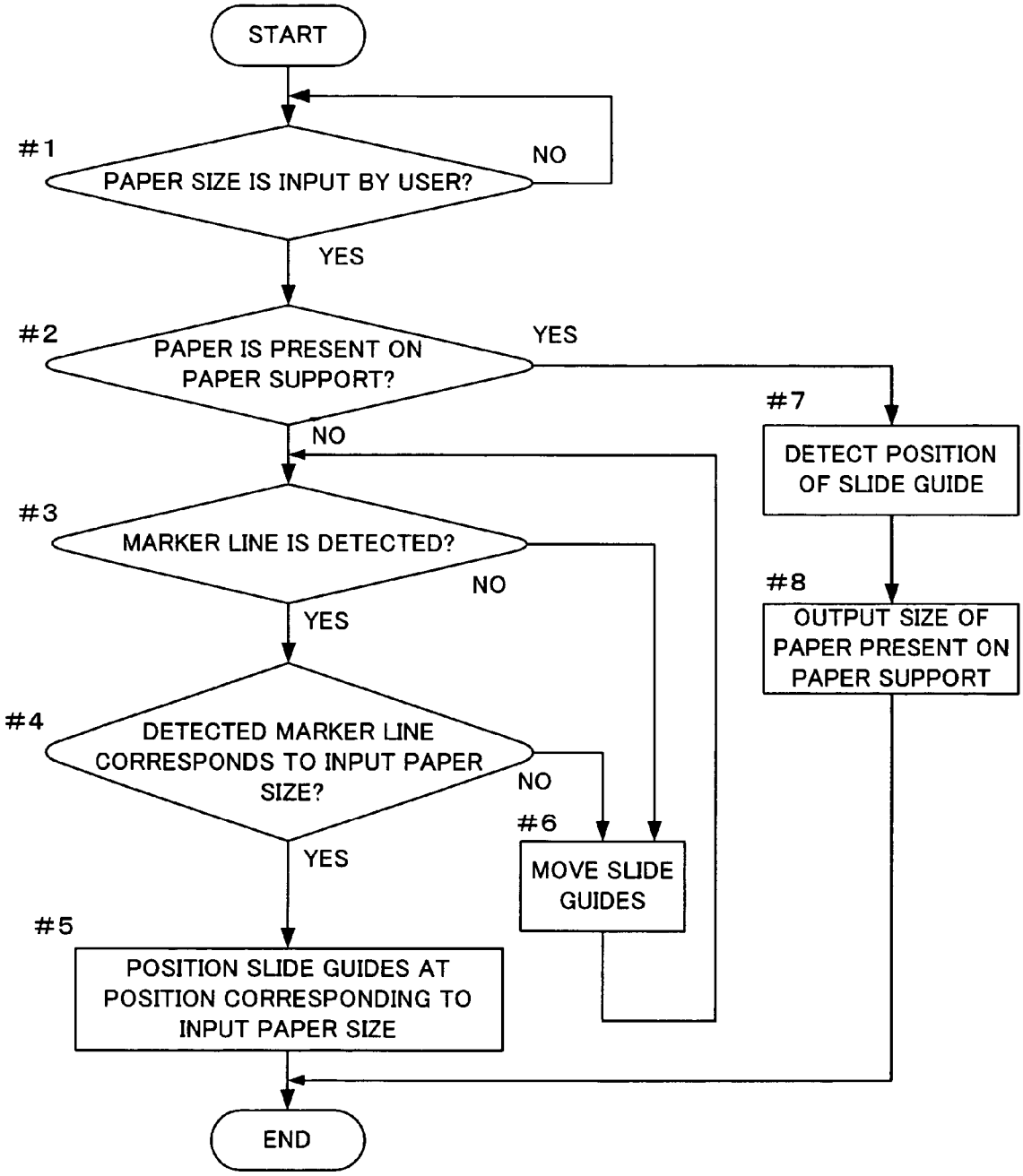
FIG. 6 is a flow chart showing the operations of slide guides of the paper feed tray unit for the printer.

FIG. 6 is a flow chart showing the operations of the slide guides 7*a*, 7*b* of the paper feed tray unit 1A for the printer 1 under the control of the controller 13 using the drive mechanism 8, paper sensor 9, guide position sensor 11, paper width detection sheet 12 and so on. When a user inputs a desired paper size, using the paper size input panel 14 (YES in #1), the controller 13 determines based on a detection signal from the paper sensor 9 whether a printing paper(s) 2 is present on the paper support 6 (#2). If the paper sensor 9 detects no reflected light, the controller determines that no printing paper 2 is present on the paper support 6 (NO in #2). If NO in #2, the controller 13 determines whether one of the marker lines 12*a* to 12*d* on the paper width detection sheet 12 (more specifically reflected light therefrom) is detected as a detection signal by the guide position sensor 11 (#3).

If one of the marker lines 12*a* to 12*d* is detected by the guide position sensor 11 (YES in #3), the controller 13 compares the output level of the detection signal with a threshold value for one of paper sizes which is preset corresponding to one of the output levels L1, L2, L3, L4 (refer to FIG. 4) so as to determine whether the output level of the detection signal is equal to the threshold value corresponding to the paper size input by the user using the paper size input panel 14 (#4). If the controller 13 determines that the output level of the detection signal is equal to the threshold value corresponding to the input paper size (YES in #4), the controller 13 outputs, to the drive mechanism 8, a command to stop the slide guides 7*a*, 7*b* so as to stop the slide guides 7*a*, 7*b* (#5), thereby ending the process. In this way, the slide guides 7*a*, 7*b* are automatically positioned at an appropriate predetermined position. Thus, it becomes possible for the user to use the printer 1 for printing by setting a desired printing paper(s) 2 of the input paper size on the paper support 6.

On the other hand, if the controller 13 determines that the guide position sensor 11 detects no reflected light from any one of the marker lines 12*a* to 12*d* in #3 above (NO in #3), or if the controller 13 determines that the detection signal is not equal to the threshold value of the paper size input by the user using the paper size input panel 14 in #4 above (NO in #4), the controller 13 controls the drive mechanism 8 to move the slide guides 7*a*, 7*b* (#6), and repeats the above-described process again from #3.

If the paper sensor 9 detects reflected light in #2 above, the controller 13 determines that a printing paper(s) 2 is present on the paper support 6 (YES in #2). Then, the controller 13 compares the detection signal from the guide position sensor 11 with the threshold values corresponding to the paper sizes so as to detect the position of the slide guide 7*a* (#7), and outputs, to the display panel 4, the position of the slide guide 7*a*, namely the paper size of the printing paper(s) 2 present on the paper support 6 (#8), thereby ending the process. Thus, if YES in #2 and if the process goes to #7, the controller 13 does not control to move the slide guides 7*a*, 7*b*, namely to allow the slide guides 7*a*, 7*b* to stay still. If the user looking at the display panel 4 finds that the paper size is different from that of the desired printing paper, the user removes the printing paper(s) 2 present on the paper support 6. Thereafter, when the user uses the paper size input panel 14 to input a desired paper size for printing (YES in #1), the controller 13 performs the process from #1 to #5, whereby the slide guides 7*a*, 7*b* move to a desired predetermined position. Thus, the user can set a desired printing paper(s) 2 on the paper support 6 so as to use the printer 1 for printing.

As described in the foregoing, when a user inputs a desired paper size for printing, using the paper size input panel 14, the paper feed tray unit 1A for the printer 1 according to the present embodiment determines whether a printing paper(s) is present on the paper support 6. If no printing paper is present on the paper support 6, the controller 13 controls the drive mechanism 8 to move the slide guides 7*a*, 7*b* to a predetermined position corresponding to the input paper size before a printing paper(s) is placed on the paper support 6. Thus, the user can easily and correctly set a desired printing paper(s) at a predetermined location.

Furthermore, since the slide guides 7*a*, 7*b* are not moved when a printing paper(s) is present on the paper support 6, it is possible to prevent the slide guides 7*a*, 7*b* from crushing the printing paper(s) on the paper support 6. This in turn makes it possible to prevent paper jam at the paper inlet or inside the printer 1 which may be caused by feeding a crushed printing paper into the printer 1. On the other hand, if a printing paper(s) is present on the paper support 6, the printer 1 displays the paper size of a printing paper(s) present on the paper support 6 when the user inputs a desired paper size for printing, using the paper size input panel 14. Accordingly, the user can easily understand the necessity of changing the printing paper(s).

It is to be noted that although certain embodiments of the present invention have been described above, various modifications are possible within the scope of the technical concept of the present invention. For example, the guide position sensor 11 is not required to be provided on the slide guide 7*a*, and can be provided e.g. on the rack member 8*a*1 which moves along with the slide guide 7*a*. In addition, the controller 13 and the paper size input panel 14 are not required to be provided in the printer 1, and can be provided in the paper feed tray unit 1A.

The present invention has been described above using presently preferred embodiments, but such description should not be interpreted as limiting the present invention. Various modifications will become obvious, evident or apparent to those ordinarily skilled in the art, who have read the description. Accordingly, the appended claims should be interpreted to cover all modifications and alterations which fall within the spirit and scope of the present invention.

What is claimed is:

1. A paper feed tray unit for a printer with a controller, comprising:

a paper support for supporting paper supplied to a paper inlet for feeding at least one printing paper into the printer in a paper feed direction and for receiving the at least one printing paper thereon;

a pair of slide guides provided on the paper support so as to be movable in a width direction which is perpendicular to the paper feed direction;

a drive mechanism which is provided with a drive motor for moving the slide guides closer to or away from each other in opposite directions, and which is controlled by the controller to automatically move the slide guides to a predetermined position according to a paper size input to the controller by a user;

a paper sensor for detecting whether or not a printing paper is present on the paper support; and a guide position sensor provided on at least one of the slide guides for detecting the position of the slide guides based on markings on a paper width detection sheet provided on a housing of the printer in the vicinity of the paper inlet at a location facing the guide position sensor and corresponding to a moving range of the guide position sensor, wherein:

the controller determines, using the paper sensor, whether a printing paper is present on the paper support;

the controller recognizes the position of the slide guides based on an output level of a detection signal, which is output from the guide position sensor by detecting the markings on the paper width detection sheet, if the controller determines that an absence of a printing paper on the paper support exists;

the controller controls the drive mechanism to move the slide guides according to the paper size input by the user for printing; and the controller stops the drive mechanism when the output level of the detection signal is equal to a level corresponding to the input paper size, while the controller allows the slide guides to stay still if the controller determines, using the paper sensor, that a printing paper is present on the paper support.

2. The paper feed tray unit for the printer according to claim 1, wherein the guide position sensor is formed of a reflection type photosensor, and the paper width detection sheet is provided with marker lines, each of which is provided at a position facing the guide position sensor when the distance between the slide guides is equal to a width of one of standard paper sizes of printing paper, and each of which has a reflectance different from those of the other marker lines for respective widths of the standard paper sizes.

3. The paper feed tray unit for the printer according to claim 2, which comprises a display panel for displaying an operational state of the printer, wherein the controller outputs, to the display panel, the paper size of a printing paper present on the paper support.

* * * * *